US010310436B2

(12) United States Patent
Yamaguchi et al.

(10) Patent No.: US 10,310,436 B2
(45) Date of Patent: Jun. 4, 2019

(54) SHEET DISCHARGE DEVICE

(71) Applicant: CANON KABUSHIKI KAISHA, Tokyo (JP)

(72) Inventors: Hiroki Yamaguchi, Yokohama (JP); Masanobu Kanoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/385,497

(22) Filed: Dec. 20, 2016

(65) Prior Publication Data

US 2017/0185026 A1 Jun. 29, 2017

(30) Foreign Application Priority Data

Dec. 28, 2015 (JP) ..... 2015-256749

(51) Int. Cl.
*G03G 15/00* (2006.01)

(52) U.S. Cl.
CPC ..... *G03G 15/6576* (2013.01)

(58) Field of Classification Search
CPC ..... G03G 15/6576
USPC ..... 399/406
See application file for complete search history.

(56) References Cited

U.S. PATENT DOCUMENTS 2,606,520 A * 8/1952 Hoel ..... D21H 5/003 101/351.4
4,315,682 A * 2/1982 Parzanici ..... G03G 15/206 219/216
5,154,411 A * 10/1992 Saito ..... B65H 39/11 271/289
7,466,952 B2 * 12/2008 Ito ..... G03G 15/2064 399/329
7,477,858 B2 * 1/2009 Fujii ..... G03G 15/2064 399/328
7,697,884 B2 * 4/2010 Tateishi ..... G03G 15/234 399/401
8,087,666 B2 * 1/2012 Honda ..... B41J 13/0036 271/207
8,150,303 B2 * 4/2012 Kim ..... G03G 15/206 399/328
8,672,322 B2 * 3/2014 Choi ..... B65H 37/00 271/273

(Continued)

FOREIGN PATENT DOCUMENTS

JP H07-179258 A 7/1995
JP 2000-056530 A 2/2000

(Continued)

*Primary Examiner* — Anthony H Nguyen
(74) *Attorney, Agent, or Firm* — Canon U.S.A., Inc. IP Division

(57) ABSTRACT

A sheet discharge device includes a discharge roller, a first roller configured to form a first nip portion by contacting the discharge roller, a second roller configured to form a second nip portion by contacting the discharge roller on a downstream side of the first roller in a rotation direction of the discharge roller, an urging unit configured to urge the first roller and the second roller toward the discharge roller, and an adjustment unit configured to adjust a ratio of a pressure of the second nip portion to a pressure of the first nip portion in a state in which the first roller and the second roller are kept in contact with the discharge roller by the urging unit, wherein a sheet is conveyed while being simultaneously held by the first nip portion and the second nip portion.

15 Claims, 13 Drawing Sheets

(56) References Cited

U.S. PATENT DOCUMENTS

| | | | | |
|---|---|---|---|---|
| 2005/0214043 | A1* | 9/2005 | Kameda | G03G 15/2017 399/328 |
| 2006/0140696 | A1* | 6/2006 | Uehara | B65H 29/12 399/406 |
| 2006/0165455 | A1* | 7/2006 | Kajita | G03G 15/6576 399/406 |
| 2007/0110490 | A1* | 5/2007 | Tateishi | G03G 15/234 399/406 |
| 2007/0217838 | A1* | 9/2007 | Yamana | G03G 15/2064 399/328 |
| 2009/0295061 | A1* | 12/2009 | Honda | B41J 13/0036 271/3.14 |
| 2015/0248105 | A1* | 9/2015 | Aoi | G03G 21/1633 399/110 |

FOREIGN PATENT DOCUMENTS

| | | | |
|---|---|---|---|
| JP | 2001-261211 | A | 9/2001 |
| JP | 5381750 | B2 | 1/2014 |

* cited by examiner

CROSS-SECTIONAL VIEW B-B

CROSS-SECTIONAL VIEW C-C

CROSS-SECTIONAL VIEW D-D

CROSS-SECTIONAL VIEW D-D

SHEET DISCHARGE DEVICE

BACKGROUND OF THE INVENTION

Field of the Invention

The present disclosure relates to a sheet discharge device, particularly relates to a sheet discharge device including a decurl unit for removing curl from a sheet.

Description of the Related Art

A conventional electro-photographic image forming apparatus, such as a printer, transfers a toner image to a sheet, fixes the toner image by applying heat and pressure to the sheet, and eventually discharges the sheet on which the toner image is fixed to a discharge tray through a sheet discharge device. Generally, a sheet is curled when heat and pressure are applied to the sheet, so that a sheet stacking property will be lowered if such a curled sheet is discharged to the discharge tray.

Therefore, the sheet discharge device conventionally includes a decurl unit for correcting curl before discharging the sheet. As the above-described decurl unit, there is a decurl unit which has a discharge roller and two pinch rollers disposed in a sheet discharge direction, and corrects curl by pressing a curled sheet against an outer circumferential face of the discharge roller with the two pinch rollers.

Sheet curvature varies considerably depending on a sheet type, a sheet thickness, an environment, and the like. Therefore, if a decurl force for pressing the sheet against the outer circumferential face of the discharge roller with the two pinch rollers is constant, and, for example, in a case where sheet curvature is small, the sheet may curl in an inverse direction.

Therefore, as a conventional decurl unit, Japanese Patent No. 5381750 discusses a sheet discharge device having a decurl unit which is configured such that an upstream side pinch roller and a downstream side pinch roller are rotatably supported with a holder and a decurl force is adjusted by moving the holder according to sheet curvature. In this decurl unit, when sheet curl with small curvature is to be corrected, the holder is moved toward the upstream side in the sheet discharge direction, and the upstream side pinch roller is separated away from a discharge roller. With this configuration, the decurl force is lowered because the sheet is pressed against the discharge roller only with the downstream side pinch roller, so that the sheet curl can be corrected appropriately even if the sheet curvature is small.

In addition, in the sheet discharge device, a sheet discharge direction after decurl is approximately orthogonal to a line that connects a rotation center of the discharge roller and a rotation center of the downstream side pinch roller. If an angle with respect to a direction horizontal to the sheet discharge direction (hereinafter, referred to as "discharge angle") is too large, the sheet is not discharged to the sheet discharge tray because a trailing end thereof leans on a discharge mechanism, so that a stacking failure will occur. Further, if the discharge angle is too small, a sheet that is being discharged is strongly rubbed with a sheet already stacked on the sheet discharge tray to push out the sheet, so that the sheet stacking property will be lowered. Therefore, the discharge angle has to be set appropriately.

However, in the sheet discharge device including the conventional decurl unit, when the holder is moved, the downstream side pinch roller also moves to the upstream side in the sheet discharge direction, and the rotation center of the downstream side pinch roller also moves to the upstream side in the sheet discharge direction. When the rotation center of the downstream side pinch roller moves to the upstream side in the sheet discharge direction, a discharge angle becomes smaller because a position of a rotation center of the discharge roller is not changed. The sheet stacking property will be therefore lowered as described above. Further, if a position of the downstream side pinch roller is set to make the discharge angle become an appropriate angle after moving the holder, the discharge angle will be too large when sheet curl with a regular curvature is to be corrected, and thus the sheet stacking property will be lowered as described above.

Furthermore, if the holder is moved and the upstream side pinch roller is separated away from the discharge roller, a nip between the discharge roller and the upstream side pinch roller is cleared, so that the sheet passes over the upstream side pinch roller and enters a nip portion between the downstream side pinch roller and the discharge roller. In this case, if the curvature is large, the sheet cannot enter the nip portion between the downstream side pinch roller and the discharge roller but enters a space between the upstream side pinch roller and the downstream side pinch roller thereby to cause a paper jam. As described above, if a decurl function of the decurl unit is changed according to sheet curvature, a paper jam may occur or a sheet stacking property may be lowered.

SUMMARY OF THE INVENTION

According to an aspect of the present disclosure, a sheet discharge device includes a discharge roller, a first roller configured to form a first nip portion by contacting the discharge roller, a second roller configured to form a second nip portion by contacting the discharge roller on a downstream side of the first roller in a rotation direction of the discharge roller, an urging unit configured to urge the first roller and the second roller toward the discharge roller, and an adjustment unit configured to adjust a ratio of a pressure of the second nip portion to a pressure of the first nip portion in a state in which the first roller and the second roller are kept in contact with the discharge roller by the urging unit, wherein a sheet is conveyed while being simultaneously held by the first nip portion and the second nip portion.

Further features of the present disclosure will become apparent from the following description of exemplary embodiments with reference to the attached drawings.

DESCRIPTION OF THE EMBODIMENTS

Figure 1:
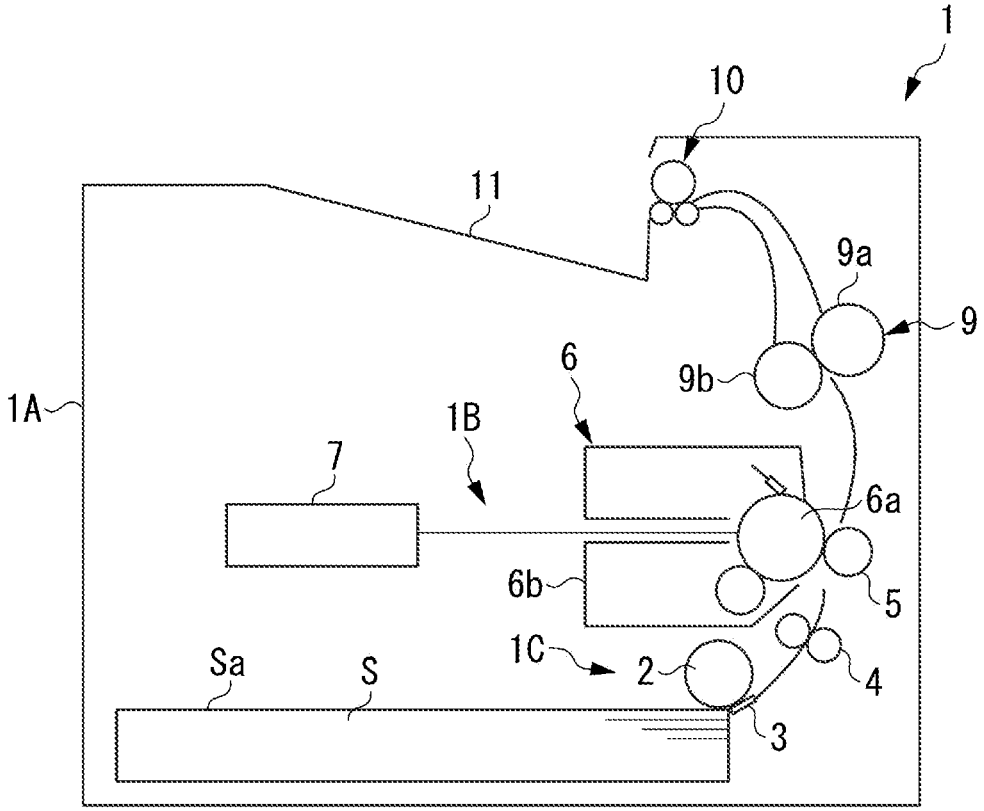
FIG. 1 is a diagram illustrating a schematic configuration of an electro-photographic printer as an example of an image forming apparatus having a sheet discharge device according to a first exemplary embodiment.

Hereinafter, an exemplary embodiment will be described in detail with reference to the appended drawings. FIG. 1 is a diagram illustrating a schematic configuration of an electro-photographic printer as an example of an image forming apparatus having a sheet discharge device according to a first exemplary embodiment.

As illustrated in FIG. 1, an image forming unit 1B for forming an image through an electro-photographic method, a sheet feeding device 1C for feeding a sheet S to the image forming unit 1B, and a sheet discharge device 10 for discharging the sheet S on which an image is formed are provided on a printer main body 1A of a printer 1.

The image forming unit 1B includes a photosensitive drum 6*a* for forming a toner image, a development unit 6*b*, a discharge roller (not illustrated) for uniformly charging a surface of the photosensitive drum 6*a*, and a process cartridge 6 detachably attached to the printer main body 1A. The image forming unit 1B further includes a laser scanner 7 and a transfer roller 5 for transferring a toner image formed on the photosensitive drum 6*a* onto the sheet S. The sheet feeding device 1C includes a feeding roller 2 for feeding sheets S stacked on and stored in a tray (not illustrated) provided on the printer main body 1A.

Then, when a printing start signal is input to the printer 1 having the above-described configuration, the feeding roller 2 rotates to feed out an uppermost sheet Sa of the sheets S stacked on and stored in the tray with the friction between the sheet Sa and the feeding roller 2. The fed sheet Sa is separated from the sheets S by a separation pad 3 one by one and conveyed to the image forming unit 1B by a conveyance roller pair 4.

Subsequently, when conveyance of the sheet Sa is started, the laser scanner 7 irradiates the photosensitive drum 6*a*, a surface of which is charged uniformly, with laser light corresponding to image information at a predetermined timing, whereby an electrostatic latent image is formed on the photosensitive drum 6*a*. Then, the electrostatic latent image formed on the photosensitive drum 6*a* is developed and visualized as a toner image by the development unit 6*b* and transferred to the sheet Sa by the transfer roller 5. Next, the sheet Sa on which the toner image has been transferred is conveyed to a fixing device 9 configured of a pressure roller 9*a* and a fixing roller 9*b*, so that the toner image is fixed onto the sheet Sa by the heat and pressure applied by the fixing device 9. After the toner image is fixed thereon, the sheet Sa is discharged to a discharge stacking tray 11 provided on an upper face of the printer main body 1A by the sheet discharge device 10.

Figure 2:
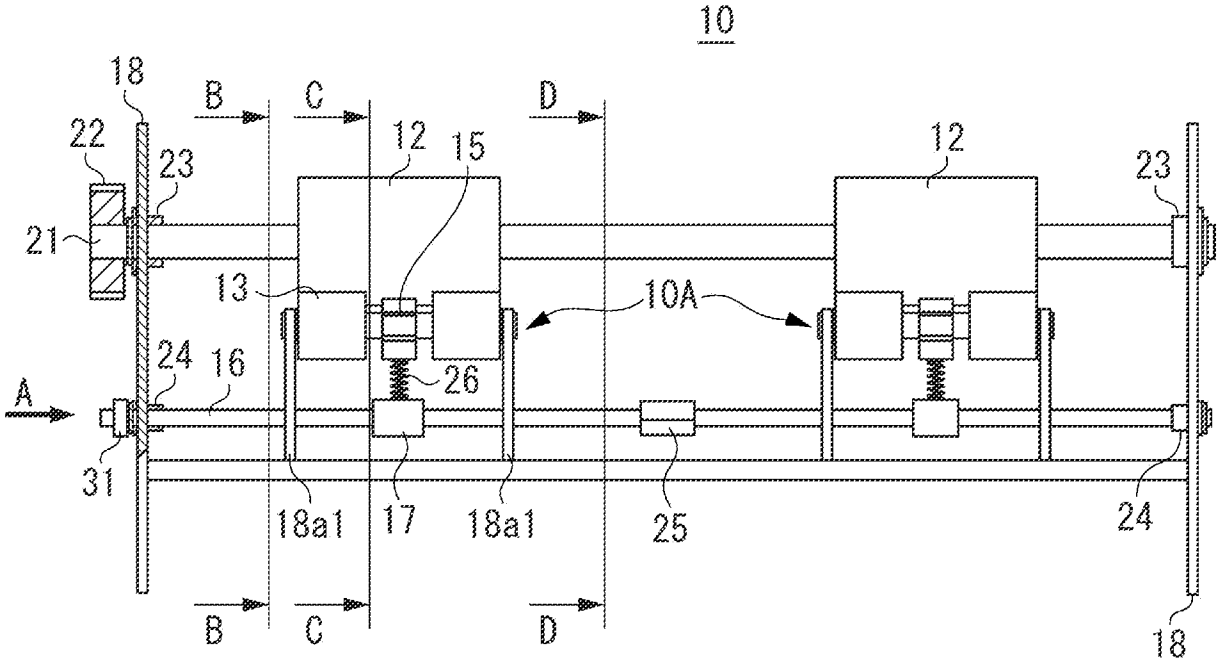
FIG. 2 is a diagram illustrating a configuration of the sheet discharge device.
Figure 3:
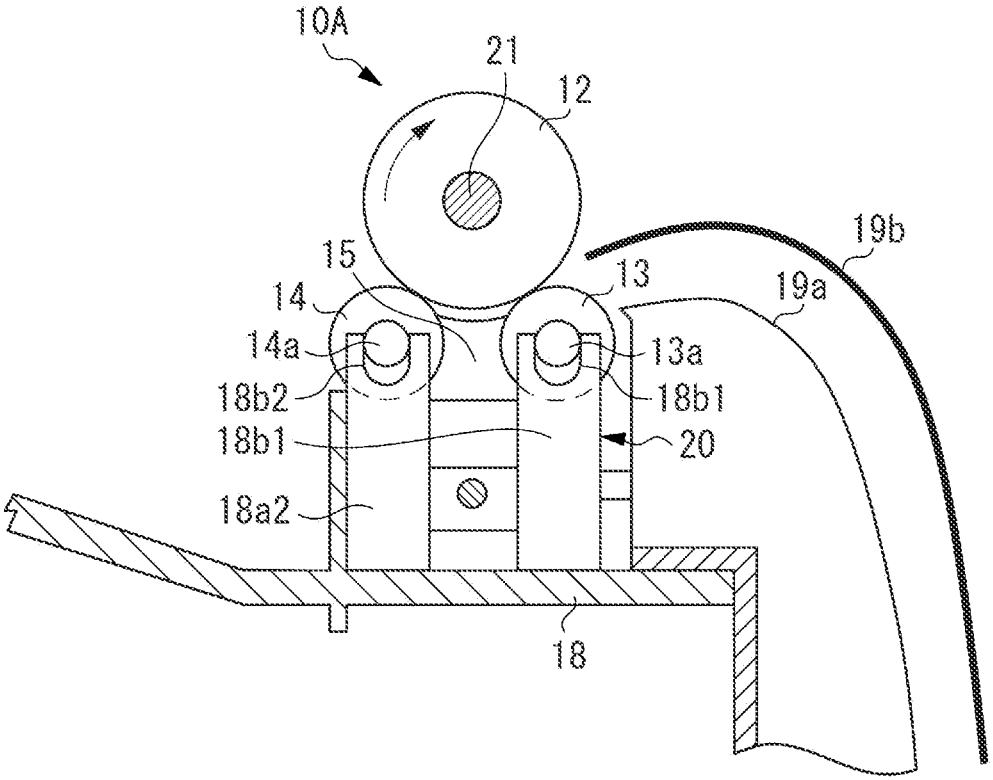
FIG. 3 is a diagram illustrating a configuration of a decurl unit provided on the sheet discharge device.

Next, the sheet discharge device 10 will be described with reference to FIGS. 2 and 3. The sheet discharge device 10 includes a discharge roller 12, an upstream side pinch roller 13 (first roller) that is press-contactable with and separable from the discharge roller 12, and a downstream side pinch roller 14 (second roller) that is press-contactable with and separable from the discharge roller 12 in a downstream side in the sheet discharge direction with respect to the upstream side pinch roller 13 (i.e., a rotation direction of the discharge roller 12). Then, the discharge roller 12, the upstream side pinch roller 13 as an upstream side roller, and the downstream side pinch roller 14 as a downstream side roller are included in a decurl unit 10A that discharges the sheet Sa while removing curl from the sheet Sa.

A surface of the discharge roller 12 is formed of a material, such as rubber, having a high friction coefficient. In the present exemplary embodiment, two discharge rollers 12 are attached to a discharge roller shaft 21. The discharge roller shaft 21 is rotatably held by a main unit frame 18 via shaft bearings 23, and a discharge roller gear 22 is attached to one end portion of the discharge roller shaft 21. Then, the discharge roller gear 22 is driven and rotated by a motor (not illustrated), so that the discharge roller shaft 21 rotates. The discharge roller 12 is rotated in a direction indicated by an arrow in FIG. 3.

The upstream side pinch roller 13 includes roller shaft portions 13*a* at both end portions in an axis direction. The roller shaft portions 13*a* are respectively attached to positioning sliding portions 18*b*1 provided on upper portions of upstream side positioning ribs 18*a*1 serving as upstream side supporting members provided on the main unit frame 18. Then, each of the upstream side pinch rollers 13 is supported by the corresponding upstream side positioning rib 18*a*1 that is included in a supporting unit, so as to be rotatable with respect to the main unit frame 18 and linearly separable with respect to the corresponding discharge roller 12.

The downstream side pinch roller 14 includes roller shaft portions 14*a* at both end portions in an axis direction. These roller shaft portions 14*a* are respectively attached to positioning sliding portions 18*b*2 provided on upper portions of positioning ribs 18*a*2 serving as supporting members provided on the main unit frame 18, so that each of the downstream side pinch rollers 14 is supported rotatably and slidably toward the corresponding discharge roller 12.

Figure 4:
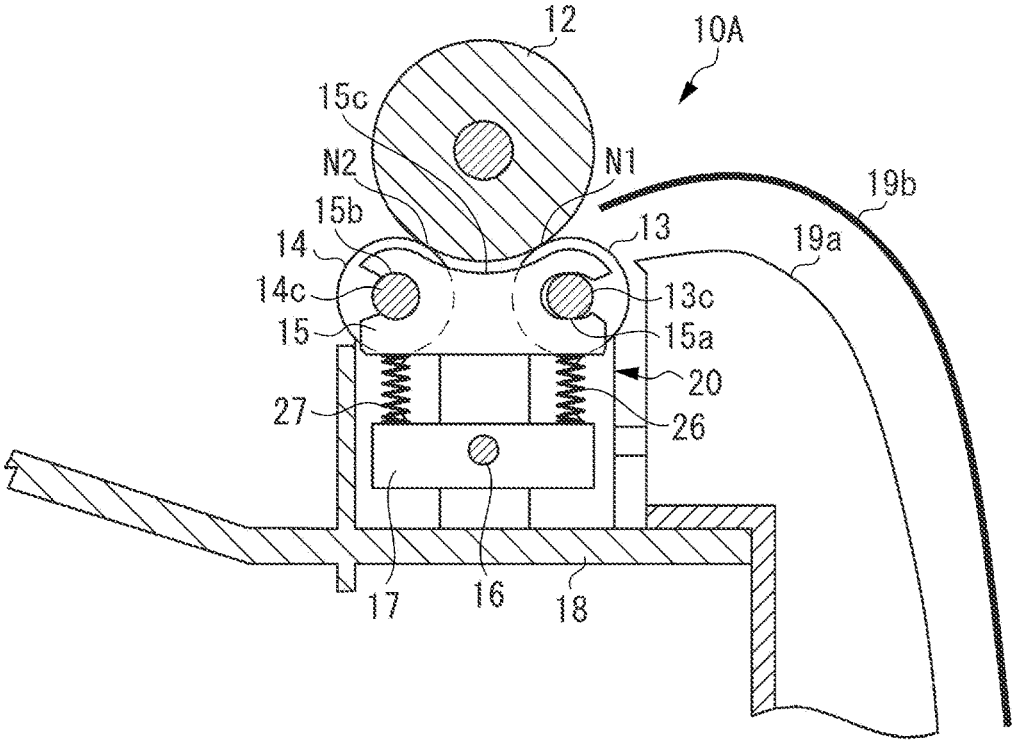
FIG. 4 is a diagram illustrating a configuration of a pressure force changing unit provided on the sheet discharge device.

As illustrated in FIG. 4, central shaft portions 13*c* and 14*c* are respectively formed on a central portion in the axis direction of the upstream side pinch roller 13 and a central portion in the axis direction of the downstream side pinch roller 14. In the present exemplary embodiment, the upstream side pinch roller 13 and the downstream side pinch roller 14 are narrowed at the central portions in the axis direction, and the central shaft portions 13*c* and 14*c* are formed by these narrowed portions. Each of the central shaft portions 13*c* and 14*c* may be formed by arranging two pinch rollers on a shaft with a space at a central portion thereof.

The central shaft portions 13*c* and 14*c* are coupled by a pressure transmission member 15 serving as a pivoting member. A holding portion 15*a* that holds the central shaft portion 13*c* of the upstream side pinch roller 13 with play in the horizontal direction is formed on an upstream end in the sheet discharge direction of the pressure transmission member 15. A fitting portion 15*b* into which the central shaft portion 14*c* of the downstream side pinch roller 14 fits is formed on a downstream end portion in the sheet discharge direction as a pivoting end portion of the pressure transmission member 15. With the above-described configuration, the pressure transmission member 15 is pivotably provided on the upstream side pinch roller 13, and the downstream side pinch roller 14 is rotatably supported by the pressure transmission member 15.

A swing member 17 is provided below the pressure transmission member 15 so as to be swingable in a direction in which the swing member 17 is in contact with or separated from the downstream side pinch roller 14. As illustrated in FIG. 2, the swing member 17 is attached to a swing member coupling shaft 16 serving as a swing shaft which is rotatably held by the main unit frame 18 via bearing shafts 24. Pressure springs, such as an upstream side pressure spring 26 serving as a first urging member and a downstream side pressure spring 27 serving as a second urging member, are arranged in a space between the swing member 17 and the pressure transmission member 15. In the present exemplary embodiment, identical springs having the same urging forces are used as the upstream side pressure spring 26 and the downstream side pressure spring 27. Further, the upstream side pressure spring 26 is arranged on the upstream side in the sheet discharge direction with respect to the swing member coupling shaft 16, whereas the downstream side pressure spring 27 is arranged on the downstream side in the sheet discharge direction with respect to the swing member coupling shaft 16.

By arranging the upstream side pressure spring 26 and the downstream side pressure spring 27 as described above, the upstream side pinch roller 13 is pressed and in contact with the discharge roller 12 mainly by the upstream side pressure spring 26 via the pressure transmission member 15 thereby to form an upstream side nip portion (first nip portion) N1. Further, the downstream side pinch roller 14 is pressed and in contact with the discharge roller 12 mainly by the downstream side pressure spring 27 via the pressure transmission member 15 thereby to form a downstream side nip portion (second nip portion) N2. As described above, the spring forces of the upstream side pressure spring 26 and the downstream side pressure spring 27 are applied to the upstream side pinch roller 13 and the downstream side pinch roller 14 via the pressure transmission member 15.

The upstream side pressure spring 26 is in charge of a pressure force (press-contact force) of the upstream side pinch roller 13 by mainly urging the upstream side pinch roller 13, whereas the downstream side pressure spring 27 is in charge of a pressure force of the downstream side pinch roller 14 by mainly urging the downstream side pinch roller 14. The pressure forces of the upstream side pinch roller 13 and the downstream side pinch roller 14 are used for removing curl from a sheet in such a manner that the curled sheet is pressed against the discharge roller 12. Further, in the present exemplary embodiment, because the central portions of the upstream side pinch roller 13 and the downstream side pinch roller 14 are pressurized via the pressure transmission member 15, the upstream side pinch roller 13 and the downstream side pinch roller 14 can uniformly apply the pressure forces to the discharge roller 12 in the axis direction. Therefore, the sheet S can be pressed against the discharge roller 12 in a well-balanced manner.

Figure 5A:
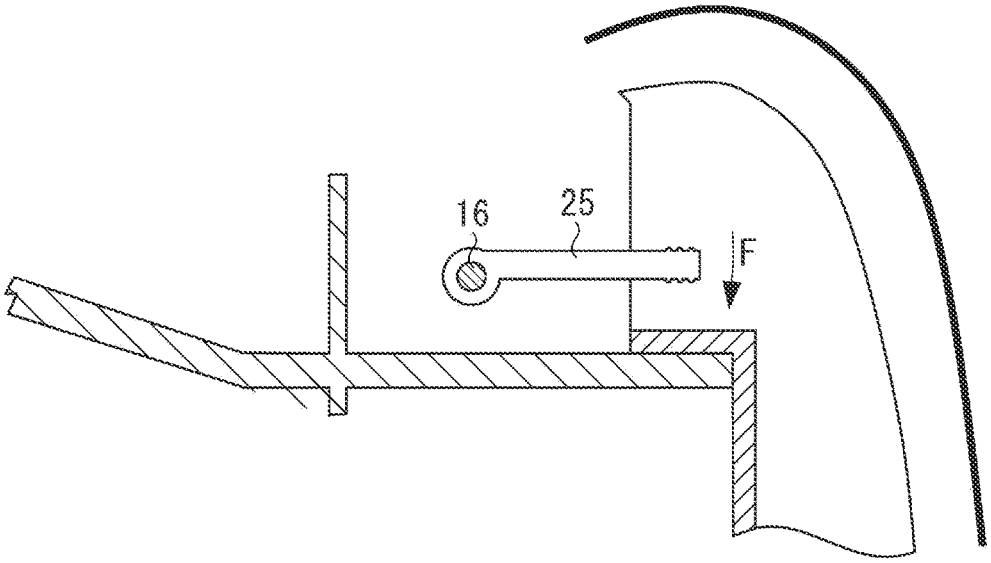
FIG. 5A is a diagram illustrating a state before an operation lever provided on the pressure force changing unit is operated.
Figure 5B:
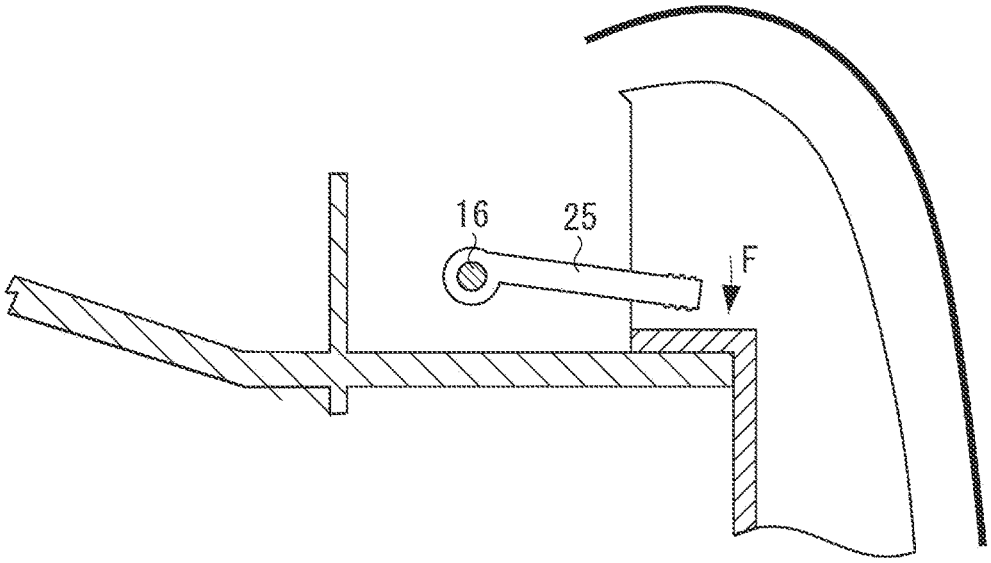
FIG. 5B is a diagram illustrating a state after the operation lever is operated.
Figure 9A:
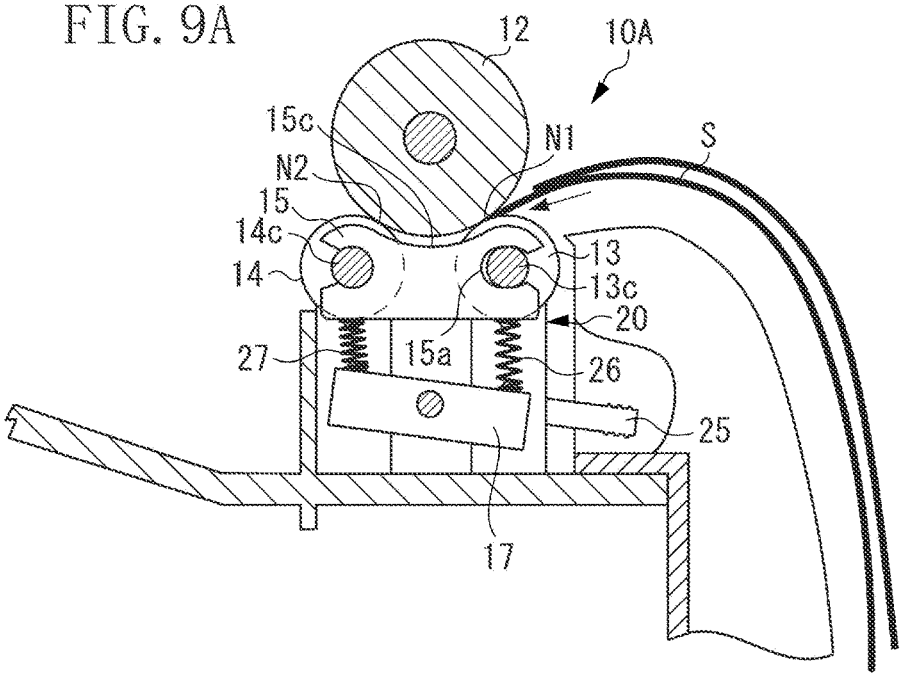
FIG. 9A is a diagram illustrating a state where a leading end of a sheet has reached the upstream side nip when the decurl unit is in a decurl setting for small curl.
Figure 9B:
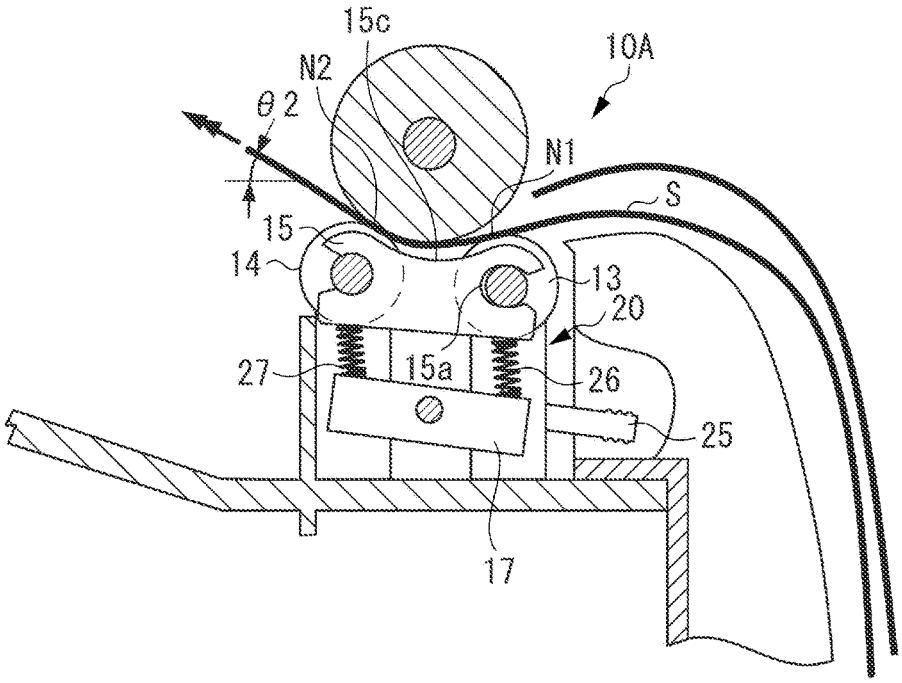
FIG. 9B is a diagram illustrating a state where a leading end of a sheet has passed through the downstream side nip when the decurl unit is in the decurl setting for small curl.

As illustrated in FIGS. 5A and 5B, a manually-operated operation lever 25 is attached to the central portion in the axis direction of the swing member coupling shaft 16. Then, as described below, when the decurl function of the decurl unit 10A is to be lowered, the operation lever 25 is operated in a direction indicated by an arrow F to make a downstream side of the swing member 17 in the sheet discharge direction swing and move close to the downstream side pinch roller 14, as illustrated in FIGS. 9A and 9B described below.

Figure 6A:
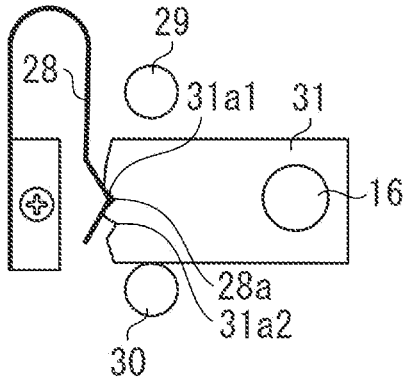
FIG. 6A is a diagram illustrating a state of a holding unit provided on the pressure force changing unit before the operation lever is operated.
Figure 6B:
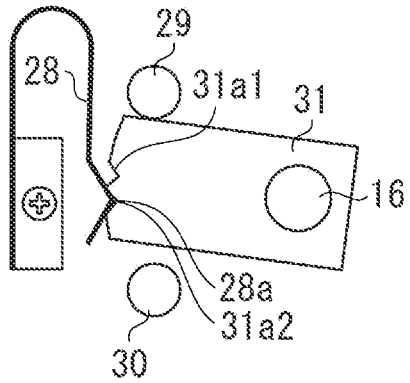
FIG. 6B is a diagram illustrating a state of the holding unit after the operation lever is operated.

Further, as illustrated in FIGS. 6A and 6B, a cam 31 as a latched member which pivots integrally with the swing member 17 is attached to one end portion of the swing member coupling shaft 16, and cam concave portions 31*a*1 and 31*a*2 as two latched portions are provided on a pivoting end portion of the cam 31. A click spring 28 as an elastic member, which elastically engages with the cam concave portions 31*a*1 and 31*a*2 when the cam 31 is rotated, is provided on the main unit frame 18 (not illustrated). Further, an upper stopper 29 for regulating the upward rotation of the cam 31 is provided on the upper side of the cam 31, and a lower stopper 30 for regulating the downward rotation of the cam 31 is provided on the lower side of the cam 31. A pivoting amount of the cam 31 in an upper/lower direction, i.e., an operation amount of the operation lever 25 in an upper/lower direction, is limited by the upper stopper 29 and the lower stopper 30.

FIG. 6A is a diagram illustrating a state of the cam 31 when the operation lever 25 is not operated as illustrated in FIG. 5A. In this state, a latching portion 28*a* of the click spring 28 engages with the cam concave portion 31*a*1 positioned on the upper portion, so that the swing member coupling shaft 16 is held in a position where the operation lever 25 is not operated.

Figure 7:
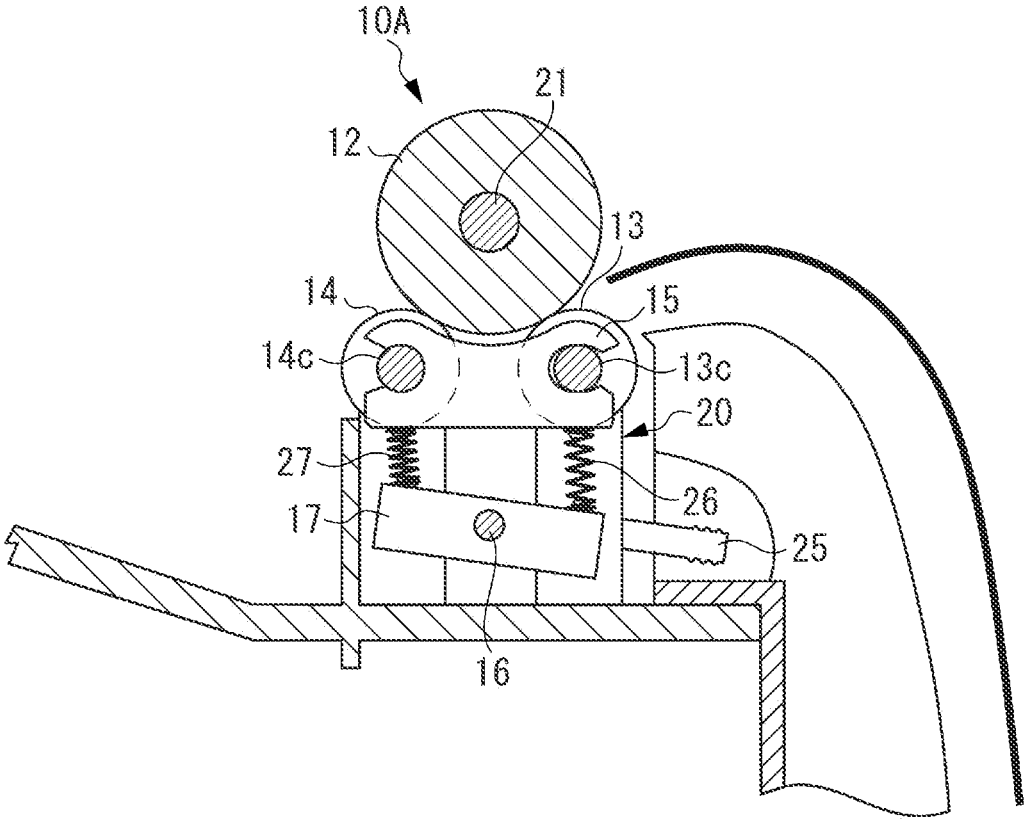
FIG. 7 is a diagram illustrating a state where a decurl function of the decurl unit is reduced.

Further, when the operation lever 25 is operated as illustrated in FIG. 5B, the swing member coupling shaft 16 is rotated, so that the cam 31 pivots according to FIG. 6B. Then, when the cam 31 pivots, the latching portion 28*a* of the click spring 28 engages with the cam concave portion 31*a*2 positioned on the lower portion. With this configuration, the swing member coupling shaft 16 is held in a position where the operation lever 25 is operated. In other words, in the present exemplary embodiment, the pivot member 17 is held by the click spring 28 and the cam 31 in a position according to the operation of the operation lever 25 as illustrated in FIG. 7.

When the operation lever 25 is operated, the swingable swing member 17 swings in such a manner that a side of the swing member 17 on the downstream side pinch roller 14 (i.e., a downstream side in the sheet discharge direction) is positioned higher than a side of the swing member 17 on the upstream side pinch roller 13. Then, when the swing member 17 swings as described above, the pressure force of the upstream side pressure spring 26 to the upstream side pinch roller 13 becomes weaker, and the pressure force of the downstream side pressure spring 27 to the downstream side pinch roller 14 becomes stronger.

As described above, by swinging the swing member 17 through the operation of the operation lever 25, it is possible to change a balance between the pressure forces, of the upstream side pressure spring 26 and the downstream side pressure spring 27, which are applied to the upstream side pinch roller 13 and the downstream side pinch roller 14. In other words, it is possible to change (adjust) a ratio of the pressure of the downstream side nip portion N2 to the pressure of the upstream side nip portion N1. Therefore, in the present exemplary embodiment, the swing member 17 and the operation lever 25 are included in a pressure force changing unit (adjustment unit) 20 as a changing unit for changing a balance between the urging forces to the upstream side pinch roller 13 and the downstream side pinch roller 14 via the pressure transmission member 15.

A setting in which the pressure force caused by the upstream side pressure spring 26 becomes weaker whereas the pressure force caused by the downstream side pressure spring 27 becomes stronger is referred to as a decurl setting for small curl in which the decurl unit 10A processes a sheet having a curvature amount smaller than a predetermined amount. A mode in which a sheet is conveyed by the decurl unit 10A which operates in the decurl setting for small curl is referred to as a first mode. In the present exemplary embodiment, even in the decurl setting for small curl, the pressure force of the upstream side pressure spring 26 will not be reduced to zero, so that the upstream side pinch roller 13 is pressed and in contact with the discharge roller 12 with a small pressure force.

The state illustrated in FIG. 4 is referred to as a decurl setting for large curl in which the decurl unit 10A corrects sheet curl from a sheet having a curvature amount of a predetermined amount or more. In the decurl setting for large curl, a ratio of the pressure of the downstream side nip portion N2 to the pressure of the upstream side nip portion N1 is set to be smaller than that of the decurl setting for small curl. A mode in which a sheet is conveyed by the decurl unit 10A which operates in the decurl setting for large curl is referred to as a second mode.

Further, in the present exemplary embodiment, because a total of the pressure forces of the upstream side pressure spring 26 and the downstream side pressure spring 27 is approximately the same in the decurl setting for small curl and the decurl setting for large curl, the conveyance force of the sheet discharge device 10 is approximately the same in any of the settings. Therefore, sliding marks of the rollers will not be formed on a sheet because the conveyance force is not too strong, and a sheet can be conveyed reliably because the conveyance force is not too weak, and thus the sheet can be discharged stably. As illustrated in FIG. 4, a concave-shaped guide portion 15*c* curved along the outer circumferential face of the discharge roller 12 is formed on an upper face of the pressure transmission member 15. With this guide portion 15*c*, a sheet conveyed through conveyance guides 19*a* and 19*b* can be guided from the upstream side nip portion N1 to the downstream side nip portion N2 without entering a space between the upstream side pinch roller 13 and the downstream side pinch roller 14.

Figure 8A:
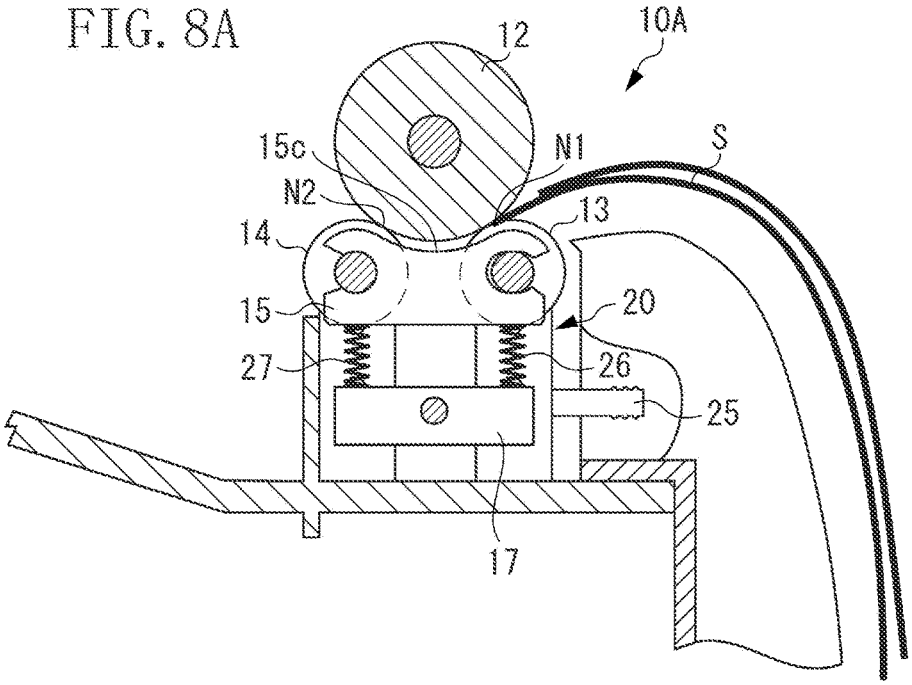
FIG. 8A is a diagram illustrating a state where a leading end of a sheet has reached an upstream side nip when the decurl unit is in a decurl setting for large curl.
Figure 8B:
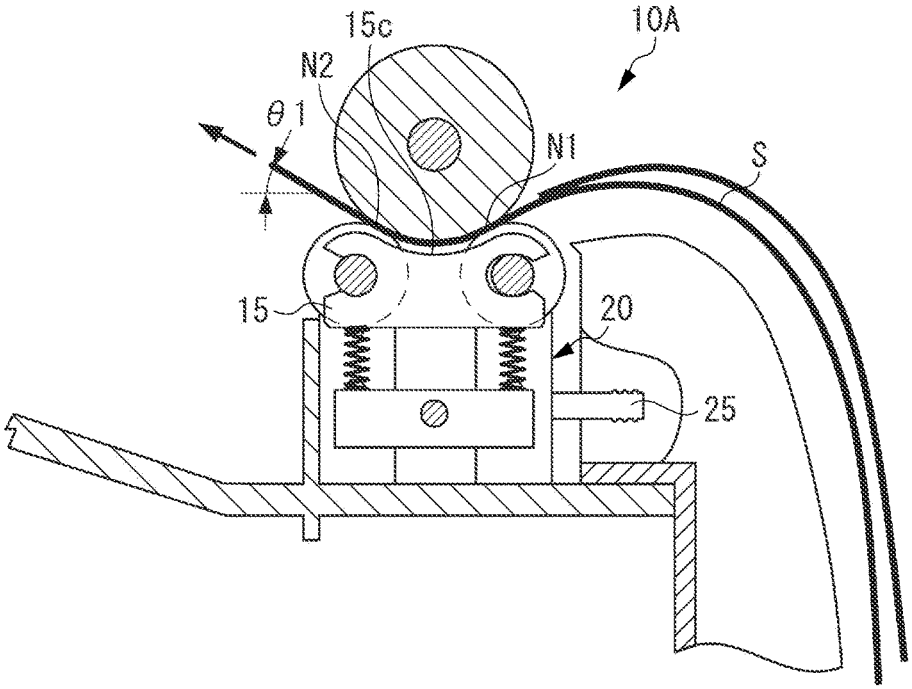
FIG. 8B is a diagram illustrating a state where a leading end of a sheet has passed through a downstream side nip when the decurl unit is in the decurl setting for large curl.

Next, a decurl operation of the decurl unit 10A configured as the above will be described. FIGS. 8A and 8B are diagrams each illustrating a decurl operation performed in the decurl setting for large curl (second mode). In this state, the swing member 17 is positioned horizontally without swinging because the operation lever 25 is not operated. Therefore, both of the upstream side pressure spring 26 and the downstream side pressure spring 27 pressurize the upstream side pinch roller 13 and the downstream side pinch roller 14 via the pressure transmission member 15 with approximately the same pressure forces.

As illustrated in FIG. 8A, when the conveyed sheet S is further conveyed after a leading end thereof has reached the upstream side nip portion N1, the leading end of the sheet S is lead to the downstream side nip portion N2 while being guided by the guide portion 15*c* of the pressure transmission member 15. Then, after the leading end of the sheet S has passed through the downstream side nip portion N2, the sheet S is discharged at a discharge angle θ1 as illustrated in FIG. 8B.

When the sheet S passes through the upstream side nip portion N1 and the downstream side nip portion N2, the upstream side pinch roller 13 and the downstream side pinch roller 14 press the sheet S against the discharge roller 12 with approximately the same forces at the upstream side nip portion N1 and the downstream side nip portion N2. With this operation, curl of the sheet S is corrected because the sheet S is pressed and stretched at curvature of the discharge roller 12. Herein, a direction in which the sheet S is discharged, i.e., the discharge angle θ1, is approximately orthogonal to a line that connects the rotation center of the discharge roller 12 and the rotation center of the downstream side pinch roller 14. This discharge angle θ1 is set as appropriate in such a manner that the sheet stacking property is not lowered.

Next, a decurl operation, of the decurl unit 10A, which is performed on a sheet having small curvature will be described. In this case, the decurl unit 10A corrects curl in the decurl setting for small curl (first mode). In this operation, the operation lever 25 that is positioned as illustrated in FIG. 5A is operated in a direction indicated by the arrow F and moved to a position illustrated in FIG. 5B.

When the operation lever 25 is moved thereto, the swing member 17 swings integrally with the operation lever 25 from a horizontal state, and the downstream side of the swing member 17 moves close to the downstream side pinch roller 14 as illustrated in FIG. 9A. When the swing member 17 swings, the pressure force of the upstream side pressure spring 26 to the upstream side pinch roller 13 becomes weaker than in the case of the pressure force in the decurl setting for large curl, and the pressure force of the downstream side pressure spring 27 to the downstream side pinch roller 14 becomes stronger than in the case of the pressure force in the decurl setting for large curl. In other words, the sheet discharge device 10 can operate in the first mode in which the sheet S is conveyed in a state where the pressure of the upstream side nip portion N1 is set to a first pressure while the pressure of the downstream side nip portion N2 is set to a second pressure, and in the second mode in which the sheet S is conveyed in a state where the pressure of the upstream side nip portion N1 is set to a third pressure that is greater than the first pressure while the pressure of the downstream side nip portion N2 is set to a fourth pressure that is smaller than the second pressure.

When the sheet S is conveyed toward the upstream side nip portion N1 in this state, the sheet S enters the upstream side nip portion N1 while being guided appropriately because the upstream side pinch roller 13 abuts on the discharge roller 12 at the upstream side nip portion N1. Thereafter, when the sheet S that has reached the upstream side nip portion N1 is conveyed further, a leading end of the sheet S is lead to the downstream side nip portion N2 while being guided by the guide portion 15*c* of the pressure transmission member 15. Then, the leading end of the sheet S passes through the downstream side nip portion N2.

In this state, although the downstream side pinch roller 14 abuts on the discharge roller 12 at the downstream side nip portion N2, as illustrated in FIG. 9B, the pressure force of the upstream side pinch roller 13 has become smaller. It is because that the upstream side pinch roller 13 moves in a lower direction due to the rigidity of the sheet S while making the pressure transmission member 15 pivot. Then, because the upstream side pinch roller 13 moves in the lower direction, winding of the sheet S around the discharge roller 12 is weakened, and thus the decurl function of the decurl unit 10A is reduced.

Further, as described above, the holding portion 15*a* of the pressure transmission member 15 has play in the horizontal direction with respect to the central shaft portion 13*c* of the upstream side pinch roller 13 as illustrated in FIGS. 9A and 9B. With this configuration, the upstream side pinch roller 13 is held by the pressure transmission member 15 so as to be movable in the horizontal direction. Therefore, even in a case where the swing member 17 swings to make the pressure transmission member 15 tilt, the upstream side pinch roller 13 linearly moves in the lower direction along the upstream side positioning rib 18*a*1 while moving in a direction separating away from the downstream side pinch roller 14 along the holding portion 15*a*.

Then, after the curl is corrected from the sheet S by the decurl unit 10A having the decurl function according to the curvature, the sheet S is discharged at a discharge angle θ2. In this process, because the pressure force is increased by the downstream side pressure spring 27, the downstream side pinch roller 14 is pressed and in contact with the discharge roller 12 while maintaining the press-contact position constant with respect to the discharge roller 12 without separating from the discharge roller 12. Therefore, the discharge angle θ2 when the decurl unit 10A is in the decurl setting for small curl is equivalent to the discharge angle θ1 when the decurl unit 10A is in the decurl setting for large curl. Accordingly, even if the decurl unit 10A discharges the sheet S in the decurl setting for small curl, the sheet stacking property will not be lowered. For example, if the discharge angle is too small, a sheet that is being discharged is strongly rubbed with a sheet already stacked on the sheet discharge tray to push out the already stacked sheet, so that the sheet stacking property will be lowered. Since the discharge angle θ2 when the decurl unit 10A is in the decurl setting for small curl is equivalent to the discharge angle θ1 when the decurl unit 10A is in the decurl setting for large curl, the discharge angle is set appropriately and the sheet stacking property will not be lowered.

As described above, in the present exemplary embodiment, the decurl unit 10A includes the pressure force changing unit 20 for changing a balance of magnitudes of the urging forces to the upstream side pinch roller 13 and the downstream side pinch roller 14. Then, in a state where the upstream side pinch roller 13 and the downstream side pinch roller 14 are pressed and in contact with the discharge roller 12, the balance of the magnitudes of the urging forces to the upstream side pinch roller 13 and the downstream side pinch roller 14 is changed by the pressure force changing unit 20. With this configuration, the decurl function can be changed without generating a paper jam or lowering a sheet stacking property.

The above description has been given for an exemplary embodiment in which a setting of the decurl function of the decurl unit 10A is changed from the large curl setting to the small curl setting when the curvature amount of the sheet S is smaller than a predetermined amount. Alternatively, an initial state of the decurl function of the decurl unit 10A may be set as the decurl setting for small curl, and the decurl function of the decurl unit 10A may be changed to the decurl setting for large curl when the curvature amount of the sheet S is a predetermined amount or more.

Figure 10A:
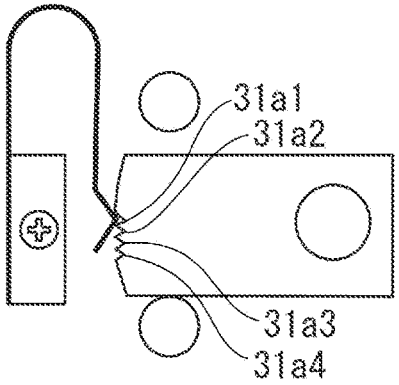
FIG. 10A is a diagram illustrating another configuration of the holding unit provided on the pressure force changing unit.

Although the above description has been given for an exemplary embodiment in which two cam concave portions 31*a*1 and 31*a*2 are provided on the cam 31, the number of cam concave portions may be three or more, and thus four cam concave portions 31*a*1, 31*a*2, 31*a*3, and 31*a*4 may be provided on the cam 31 in the rotation direction of the cam 31 as illustrated in FIG. 10A. Then, the click spring 28 may be latched with any one of the four cam concave portions 31*a*1, 31*a*2, 31*a*3, and 31*a*4 according to a swinging amount of the swing member 17. Further, the cam 31 may be stopped at any positions. By arranging a plurality of cam concave portions or making the cam 31 be stopped at any positions as described above, the decurl function can be changed more precisely, and thus the curl can be corrected more reliably.

Figure 10B:
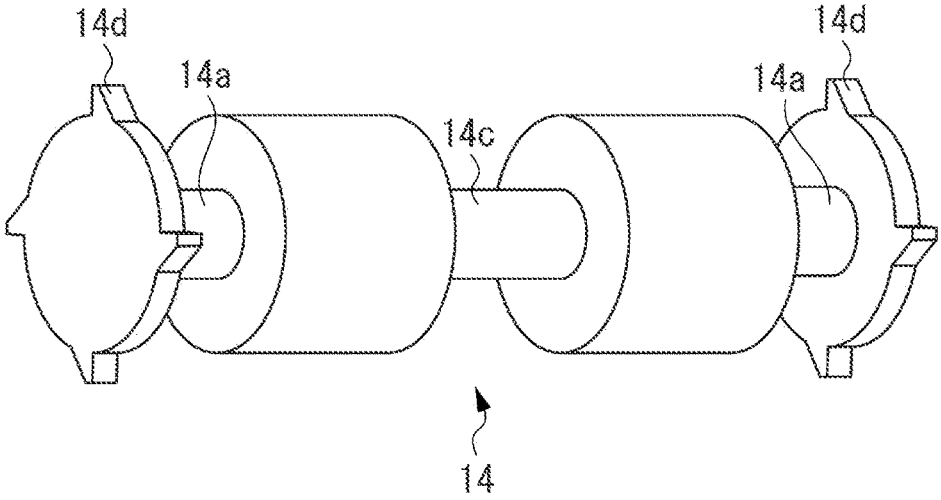
FIG. 10B is a diagram illustrating another configuration of the downstream side pinch roller provided on the decurl unit.

Further, as illustrated in FIG. 10B, a pinch roller 14 having sheet kick-out protrusions 14*d* at both end portions in the axis direction thereof may be used as the downstream side pinch roller 14. By using the above-described downstream side pinch roller 14, the sheet S can be discharged without making the trailing end lean on the discharge mechanism, and thus the stacking property of the sheet S can be improved.

Figure 11A:
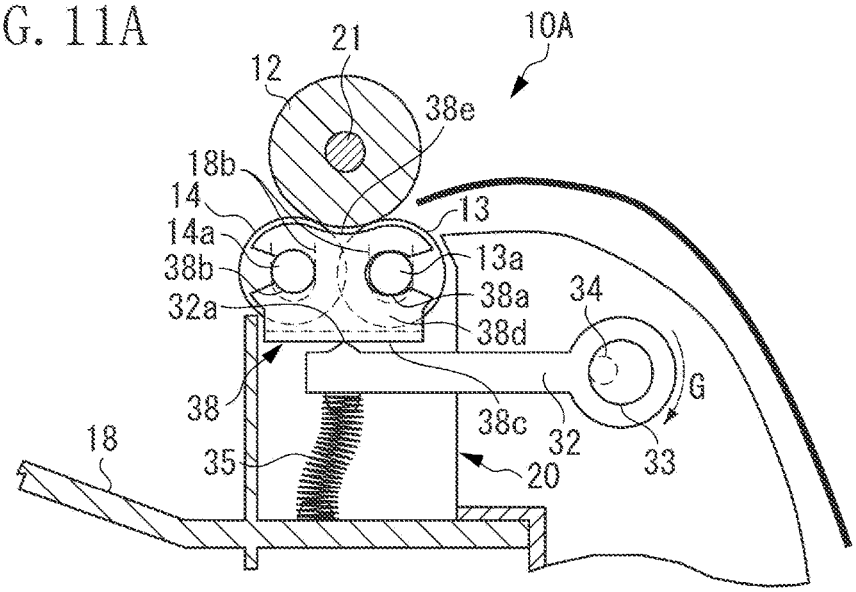
FIG. 11A is a diagram illustrating a state where a decurl unit provided on a sheet discharge device according to a second exemplary embodiment is in a decurl setting for large curl.
Figure 11B:
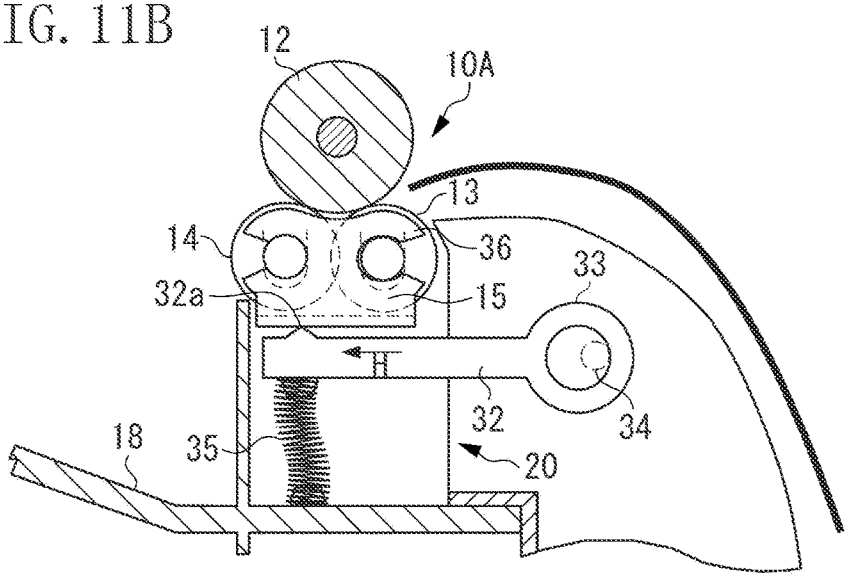
FIG. 11B is a diagram illustrating a state where the decurl unit is in a decurl setting for small curl.

A second exemplary embodiment will be described. FIGS. 11A and 11B are diagrams illustrating a configuration of a decurl unit provided on a sheet discharge device according to the present exemplary embodiment. In FIGS. 11A and 11B, reference numerals which are the same as those illustrated in FIG. 3 represent the same or corresponding portions.

As illustrated in FIG. 11A, an upstream side pinch roller 13 and a downstream side pinch roller 14 are coupled to each other by a pressure transmission member 38 serving as a pivoting member. Supporting portions 38*d* are arranged opposite to each other on both end portions in the axis direction of the pressure transmission member 38. Then, a holding portion 38*a* for holding an upstream side pinch roller shaft portion 13*a* with play in the horizontal direction is formed on the upstream end portion in the sheet discharge direction of each of the supporting portions 38*d*, and a fitting portion 38*b* into which a downstream side pinch roller shaft portion 14*a* fits is formed on a downstream end portion in the sheet discharge direction.

With this configuration, the pressure transmission member 38 is pivotably provided on the upstream side pinch roller 13, and the downstream side pinch roller 14 is rotatably supported by the pressure transmission member 38 so as to be movable in the horizontal direction. Further, the upstream side pinch roller shaft portion 13*a* and the downstream side pinch roller shaft portion 14*a* are held rotatably while being held away from the discharge roller 12 by the positioning ribs 18*a*1 and 18*a*2 of the main unit frame 18 illustrated in FIG. 3.

Furthermore, a pressure intermediate transmission arm 32 as a press-contact member is provided on the lower side of the pressure transmission member 38. A pressure intermediate transmission arm pressure portion 32*a* serving as a press-contact portion, which is pressed and in contact with a lower face 38*c* of the pressure transmission member 38, is protruded from an upper face of a downstream end portion in the sheet discharge direction of the pressure intermediate transmission arm 32. Further, a pressure spring 35 as an urging unit is provided on a space between the main unit frame 18 and the pressure intermediate transmission arm 32. Then, the pressure intermediate transmission arm 32 is pressurized in an upper direction by the pressure spring 35, so as to be pressed and in contact with the pressure transmission member 38 pivotably held by the downstream side pinch roller shaft portion 14*a*. Further, a concave-shaped guide portion 38*e* curved along the outer circumferential face of the discharge roller 12 is formed on the upper face of the pressure transmission member 38.

Furthermore, an eccentric cam 33 as a moving unit fixed to an eccentric cam shaft 34, which is rotated by a motor (not illustrated), is attached to the upstream end portion in the sheet discharge direction of the pressure intermediate transmission arm 32. Then, the pressure intermediate transmission arm 32 is moved by rotation of the eccentric cam 33.

FIG. 11A is a diagram illustrating a state where the decurl unit 10A is in the decurl setting for large curl. In this state, the pressure intermediate transmission arm pressure portion 32*a* is set so that the pressure intermediate transmission arm pressure portion 32*a* is positioned approximately in the middle of the upstream side pinch roller 13 and the downstream side pinch roller 14. In this state, when the eccentric cam 33 is rotated by approximately 180-degree in a direction G, the pressure intermediate transmission arm 32 is moved in a direction H as illustrated in FIG. 11B.

With this operation, the pressure intermediate transmission arm pressure portion 32*a* moves so as to be closer to the downstream side pinch roller 14 along the lower face 38*c* of the pressure transmission member 38. The moving amount of the pressure intermediate transmission arm 32 is set in such a state that the pressure intermediate transmission arm pressure portion 32*a* does not move beyond a position immediately beneath the downstream side pinch roller 14.

By movement of the pressure intermediate transmission arm 32, the pressure force of the pressure spring 35 to the upstream side pinch roller 13 via the pressure transmission member 38 and the pressure intermediate transmission arm 32 becomes smaller than the pressure force to the downstream side pinch roller 14. As described above, by movement of the pressure intermediate transmission arm 32, a state of the decurl unit 10A is changed from the decurl setting for large curl to the decurl setting for small curl. Therefore, in the present exemplary embodiment, the pressure intermediate transmission arm 32 and the eccentric cam 33 are included in a pressure force changing unit 20 as a changing unit for changing a balance between the urging forces to the upstream side pinch roller 13 and the downstream side pinch roller 14 via the pressure transmission member 38.

Even if the decurl setting is changed to the decurl setting for small curl, the downstream side pinch roller 14 is pressed and in contact with the discharge roller 12 at a constant position without separating away from the discharge roller 12. Accordingly, in the present exemplary embodiment, similar to the first exemplary embodiment described above, because a discharge angle can be also kept constant in the decurl setting for small curl, the decurl function can be changed without generating a paper jam or lowering a sheet stacking property.

Figure 12A:
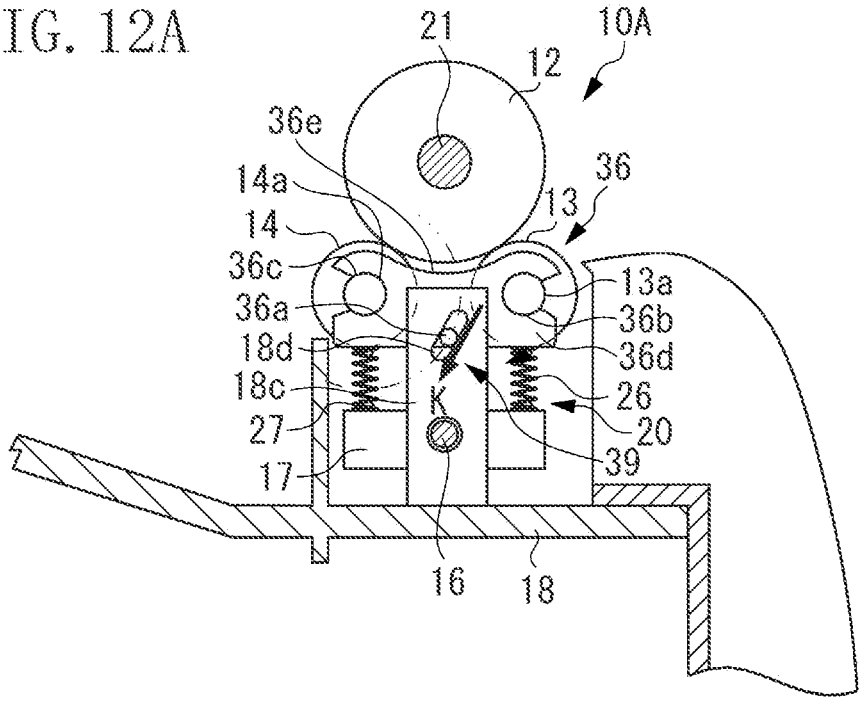
FIG. 12A is a diagram illustrating a state where a decurl unit provided on a sheet discharge device according to a third exemplary embodiment is in a decurl setting for large curl.
Figure 12B:
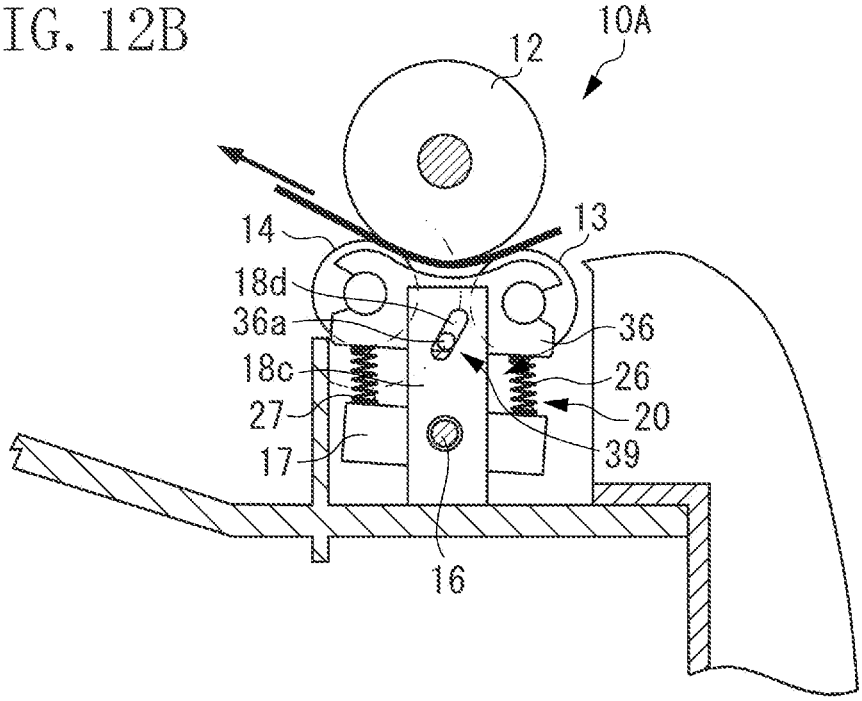
FIG. 12B is a diagram illustrating a state where the decurl unit is in a decurl setting for small curl.

A third exemplary embodiment will be described. FIGS. 12A and 12B are diagrams illustrating a configuration of a decurl unit provided on a sheet discharge device according to the present exemplary embodiment. In FIGS. 12A and 12B, reference numerals which are the same as those illustrated in FIG. 3 represent the same or corresponding portions.

As illustrated in FIG. 12A, an upstream side pinch roller 13 and a downstream side pinch roller 14 are held by a pinch roller holding member 36 serving as a pivoting member. Supporting portions 36*d* are arranged opposite to each other on both end portions in the axis direction of the pinch roller holding member 36. Then, a fitting portion 36*b* into which an upstream side pinch roller shaft portion 13*a* fits is formed on an upstream end in the sheet discharge direction of each of the supporting portions 36*d*, and a fitting portion 36*c* into which a downstream side pinch roller shaft portion 14*a* fits is formed on a downstream end in the sheet discharge direction. Further, a concave-shaped guide portion 36*e* curved along the outer circumferential face of the discharge roller 12 is formed on an upper face of the pinch roller holding member 36.

A positioning protrusion 36*a* is provided on each of the supporting portions 36*d* of the pinch roller holding member 36, and positioning ribs 18*c* as counter supporting members are provided opposite to each other in the axis direction on the main unit frame 18. A sliding elongate hole 18*d* in which the positioning protrusion 36*a* of the pinch roller holding member 36 is latched slidably is formed on each of the positioning ribs 18*c*. In addition, the sliding elongate hole 18*d* is formed into an arc-like shape with the downstream side pinch roller 14 as a center.

When the positioning protrusion 36*a* is latched in the sliding elongate hole 18*d*, the pinch roller holding member 36 is supported so that the pinch roller holding member 36 pivotably moves in a direction indicated by an arrow K along the sliding elongate hole 18*d*. As described above, in the present exemplary embodiment, the sliding elongate hole 18*d* and the positioning protrusion 36*a* are included in a guiding unit 39 that guides the movement of the upstream side pinch roller 13 by guiding the pivotal movement of the pinch roller holding member 36.

Then, similar to the first exemplary embodiment, the operation lever 25 is operated when the decurl function of the decurl unit 10A is changed. In addition, FIG. 12A is a diagram illustrating a state where the decurl unit 10A is in the decurl setting for large curl. By the operation of the operation lever 25, the decurl setting of the decurl unit 10A becomes the decurl setting for small curl illustrated in FIG. 12B.

When the operation lever 25 is operated, the upstream side pinch roller 13 moves in a direction separating away from the discharge roller 12 by making the downstream side pinch roller 14 as a center together with the pinch roller holding member 36 that pivots around the downstream side pinch roller 14. However, in this operation, because the pinch roller holding member 36 pivots around the downstream side pinch roller 14, the downstream side pinch roller 14 is pressed and in contact with the discharge roller 12 at a constant position without separating away from the discharge roller 12. Accordingly, in the present exemplary embodiment, similar to the first and the second exemplary embodiments described above, because the discharge angle can be also kept constant in the decurl setting for small curl, the decurl function can be changed without generating a paper jam or lowering a sheet stacking property.

Furthermore, in the present exemplary embodiment, although description has been given to an exemplary embodiment in which the sliding elongate hole 18*d* is provided on the positioning rib 18*c*, and the positioning protrusion 36*a* is provided on the pinch roller holding member 36, the present invention is not limited thereto. The sliding elongate hole 18*d* may be provided on the pinch roller holding member 36, and the positioning protrusion 36*a* may be provided on the positioning rib 18*c*. In other words, the positioning protrusion 36*a* may be provided on any one of the pinch roller holding member 36 and the positioning rib 18*c*, and the sliding elongate hole 18*d* may be provided on another one of the pinch roller holding member 36 and the positioning rib 18*c*.

Figure 13:
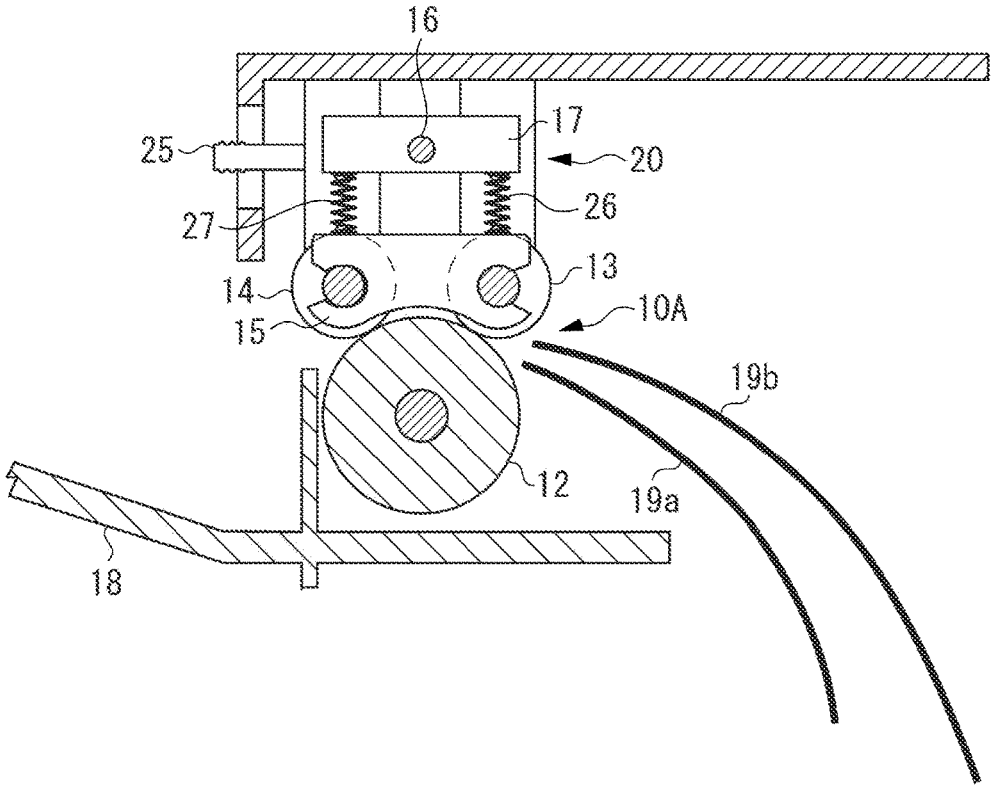
FIG. 13 is a diagram illustrating another configuration of the sheet discharge device according to the first exemplary embodiment.

Further, depending on the configuration of the image forming apparatus, sheet curl may be formed in an inverse direction with respect to the one described above. In this case, as illustrated in FIG. 13, for example, the sheet discharge device 10 according to the first exemplary embodiment may be arranged on the printer main body 1A by making the entire configuration upside down. With this configuration, sheet curl in the inverse direction can be corrected because the upstream side pinch roller 13 and the downstream side pinch roller 14 are positioned on the upper side of the discharge roller 12.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-256749, filed Dec. 28, 2015, which is hereby incorporated by reference herein in its entirety.

What is claimed is:

1. A sheet discharge device comprising:

a discharge roller;

a first roller configured to form a first nip portion by contacting the discharge roller;

a second roller configured to form a second nip portion by contacting the discharge roller on a downstream side of the first roller in a rotation direction of the discharge roller;

an urging unit configured to urge the first roller and the second roller toward the discharge roller;

an adjustment unit configured to adjust a ratio of a pressure of the second nip portion relative to a pressure of the first nip portion in a state in which the first roller and the second roller are kept in contact with the discharge roller by the urging unit; and a stacking unit on which a sheet is to be stacked, wherein, in a case where the ratio is adjusted by the adjustment unit to a first ratio, the sheet that passes through the second nip portion is decurled and discharged directly toward the stacking unit at a first discharge angle, and wherein, in a case where the ratio is adjusted by the adjustment unit to a second ratio that is different from the first ratio, the sheet that passes through the second nip portion is decurled and discharged directly toward the stacking unit at a second discharge angle that is equivalent to the first discharge angle.

2. The sheet discharge device according to claim 1, wherein the sheet discharge device is configured to operate in a first mode and a second mode, wherein the first mode is a mode in which the sheet is conveyed in a state where the ratio is set to the first ratio, and wherein the second mode is a mode in which the sheet is conveyed in a state where the ratio is set to the second ratio that is smaller than the first ratio.

3. The sheet discharge device according to claim 1, wherein the sheet discharge device is configured to operate in a first mode and a second mode, wherein the first mode is a mode in which the sheet is conveyed in a state where the pressure of the first nip portion is set to a first pressure and the pressure of the second nip portion is set to a second pressure, and wherein the second mode is a mode in which the sheet is conveyed in a state where the pressure of the first nip portion is set to a third pressure that is greater than the first pressure and the pressure of the second nip portion is set to a fourth pressure that is smaller than the second pressure.

4. The sheet discharge device according to claim 1, wherein the urging unit includes a first spring configured to urge the first roller, and a second spring configured to urge the second roller.

5. The sheet discharge device according to claim 4, wherein the adjustment unit supports the first spring and the second spring, includes a pivoting member configured to pivot on a pivoting shaft, and changes the ratio based on an orientation of the pivoting member.

6. The sheet discharge device according to claim 1, wherein the sheet discharge device is included in an electrophotographic printer.

7. The sheet discharge device according to claim 1, wherein the first roller and the second roller are narrowed at a central portions in an axis direction of an axis of the first roller.

8. The sheet discharge device according to claim 1, further comprising a holding portion configured to hold the second roller and to hold the first roller in a horizontal direction with play so that the holding portion is configured to rotate relative to the second roller and to pivot relative to the first roller.

9. The sheet discharge device according to claim 1, wherein the first ratio is such that the first roller and the second roller unevenly apply pressure forces to the discharge roller, and wherein the second ratio is such that the first roller and the second roller uniformly apply pressure forces to the discharge roller.

10. The sheet discharge device according to claim 1, wherein the adjustment unit is configured to adjust the ratio of a pressure of the second nip portion relative to a pressure of the first nip portion based on a curvature amount of a sheet relative to a predetermined curvature amount.

11. The sheet discharge device according to claim 1, wherein, in the case where the ratio is adjusted by the adjustment unit to the first ratio, a total pressure force applied to the discharge roller by the first roller and the second roller is approximately the same as a total pressure force applied to the discharge roller by the first roller and the second roller in the case where the ratio is adjusted by the adjustment unit to the second ratio.

12. The sheet discharge device according to claim 1, wherein the adjustment unit is configured to adjust the pressure ratio in a way that the discharge roller, the first roller, and the second roller avoid forming sliding marks on a sheet conveyed through the discharge roller, the first roller, and the second roller while reliably conveying the sheet.

13. The sheet discharge device according to claim 1, wherein, in the case where the ratio is adjusted by the adjustment unit to the first ratio, a winding force of a sheet wound around the discharge roller is less than a winding force of a sheet wound around the discharge roller in the case where the ratio is adjusted by the adjustment unit to the second ratio.

14. The sheet discharge device according to claim 1, further comprising a holding portion configured to hold the second roller and to hold the first roller in a horizontal direction with play so that, as the adjustment unit swings, the first roller moves linearly.

15. The sheet discharge device according to claim 1, wherein, regardless of the change of the ratio by the adjustment unit, each discharge angle remains equivalent to other discharge angles whereby a sheet stacking property is not lowered as a result of the change of the ratio by the adjustment unit.

* * * * *